US008783479B2

(12) United States Patent
Ewerding

(10) Patent No.: US 8,783,479 B2
(45) Date of Patent: Jul. 22, 2014

(54) COUPLING ARRANGEMENT FOR THE FRONT OF A TRACKED VEHICLE

(71) Applicant: Voith Patent GmbH, Heidenheim (DE)

(72) Inventor: Thomas Ewerding, Salzgitter (DE)

(73) Assignee: Voith Patent GmbH, Heidenheim (DE)

( * ) Notice: Subject to any disclaimer, the term of this patent is extended or adjusted under 35 U.S.C. 154(b) by 96 days.

(21) Appl. No.: 13/681,158

(22) Filed: Nov. 19, 2012

(65) Prior Publication Data

US 2013/0126458 A1 May 23, 2013

(30) Foreign Application Priority Data

Nov. 21, 2011 (EP) ..... 11189905

(51) Int. Cl.

| | |
|---|---|
| ***B61G 9/00*** | (2006.01) |
| ***B61G 11/16*** | (2006.01) |
| ***B61G 3/16*** | (2006.01) |
| ***B61G 7/00*** | (2006.01) |

(52) U.S. Cl.

CPC *B61G 7/00* (2013.01); *B61G 11/16* (2013.01); *B61G 3/16* (2013.01)

USPC ..... 213/7; 213/221

(58) Field of Classification Search

USPC ..... 213/7–9, 220–222

See application file for complete search history.

(56) References Cited

U.S. PATENT DOCUMENTS

| | | | | |
|---|---|---|---|---|
| 1,339,743 | A * | 5/1920 | Davis | 213/221 |
| 2,873,994 | A * | 2/1959 | Omps | 293/134 |
| 3,899,047 | A * | 8/1975 | Maeda et al. | 188/374 |
| 4,576,294 | A * | 3/1986 | Forster | 213/9 |
| 6,685,040 | B2 * | 2/2004 | Heinisch et al. | 213/221 |
| 6,820,759 | B1 * | 11/2004 | Schindler et al. | 213/221 |
| 2002/0178967 | A1 * | 12/2002 | Heinisch et al. | 105/220 |
| 2013/0126458 | A1 * | 5/2013 | Ewerding | 213/7 |

FOREIGN PATENT DOCUMENTS

| | | | |
|---|---|---|---|
| DE | 4302444 | A1 | 8/1994 |
| EP | 1927524 | A1 | 6/2008 |
| EP | 2277762 | A2 | 1/2011 |
| FR | 2531392 | A1 | 2/1984 |
| WO | WO 02/096734 | A1 | 12/2002 |

OTHER PUBLICATIONS

European Patent Office, Extended European Search Report for Application No. EP 11189905.0, dated May 12, 2011, 5 pages, Germany.

* cited by examiner

*Primary Examiner* — Jason C Smith
(74) *Attorney, Agent, or Firm* — Alston & Bird LLP

(57) ABSTRACT

A coupling arrangement for the front of a tracked vehicle is disclosed, comprising a central buffer coupling having a gladhand, a coupling shaft supporting the gladhand and a bearing, via which the coupling shaft can be joined with the undercarriage of the vehicle pivotable in a horizontal and/or vertical direction. An energy consuming device allocated to the central buffer coupling having at least one energy consuming element with a destructive design is provided. To ensure maximum energy consumption in a crash with a course of events definable in advance, the coupling arrangement additionally comprises a supporting structure with two longitudinal beams arranged on the sides of the central buffer coupling and a crossbeam joined with the two longitudinal beams, said crossbeam beam being arranged above the central buffer coupling such that a vertical deflection of the coupling shaft relative to the undercarriage of the vehicle is limited by the crossbeam.

20 Claims, 7 Drawing Sheets

COUPLING ARRANGEMENT FOR THE FRONT OF A TRACKED VEHICLE

CROSS-REFERENCE TO RELATED APPLICATIONS

This application claims priority to European Patent Application Serial No. EP 11 189 905.0, filed Nov. 21, 2011, the contents of which is hereby incorporated by reference in its entirety.

BACKGROUND OF THE INVENTION

1. Related Field

The present invention relates to a coupling arrangement according to the preamble of the independent patent claim 1.

Accordingly, the invention in particular relates to a coupling arrangement for the front of a tracked vehicle, in particular a rail vehicle, wherein the coupling arrangement comprises a central buffer coupling having a gladhand, a coupling shaft supporting the gladhand and a bearing via which the coupling shaft can be joined with the undercarriage of the vehicle pivotable in horizontal and/or vertical direction, and wherein the coupling arrangement furthermore comprises an energy consuming device allocated to the central buffer coupling having at least one energy consuming element with a destructive design. In so doing, it is in particular provided that the energy consuming element is designed such that it responds when a critical impact force defined in advance applied to the gladhand is exceeded and that it releases at least part of the energy generated in connection with the transmission of the impact force and introduced into the energy consuming device via the coupling shaft via plastic deformation with the simultaneous longitudinal motion of the central buffer coupling relative to the undercarriage of the vehicle.

2. Related Art

The principal of the present type of coupling arrangement may be generally understood from the prior art. In rail vehicle technology, it serves, for instance, the purpose of joining the freight car body of a vehicle with an adjacent freight car body.

Moreover, with respect to rail vehicle technology, it has been disclosed to provide a shock absorber at the front side of a freight car body, which commonly consists of a combination of an absorbing device, for example in the form of a spring-loaded apparatus, and an energy consuming device. The purpose of the absorbing device is to absorb the tractive and impact forces occurring in regular driving mode and transmitted between two adjacent freight car bodies via the central buffer coupling. In contrast, the purpose of the energy absorbing device is to also protect the vehicle in particular in connection with higher collision speeds.

In so doing, it is normally provided that the absorbing device absorbs a defined scope of tractive and impact forces, while passing on forces beyond this scope to the undercarriage of the vehicle. As a result, tractive and impact forces which occur, for instance, between the individual freight car bodies of a multiple-unit rail vehicle during regular driving mode are absorbed by this absorbing device which normally has a regenerative design.

In contrast, if the operational load of the absorbing device is exceeded, such as if the vehicle hits an obstacle or if the vehicle is abruptly slowed down, there is a risk that the interface between the adjacent freight car bodies, in particular the absorbing device and the possibly provided link or coupling joint between the individual freight car bodies, may potentially get destroyed or damaged. In any case, the absorbing device is inadequate to absorb the overall accumulated energy. As a result, the absorbing device is then no longer incorporated in the energy consuming concept of the entire vehicle.

In order to prevent the accumulated impact energy from being transmitted directly onto the undercarriage of the vehicle in said crash scenario, it is known from rail vehicle technology to connect an energy consuming device downstream of the absorbing device. The corresponding energy consuming device connected downstream normally responds as soon as the operating load of the absorbing device is exceeded and serves the purpose of consuming accumulated impact energy at least partially, i.e., to convert it, for instance, into thermal energy and unit resilience. The provision of said type of energy consuming device is generally recommendable for reasons of derailing safety, in order to prevent the impact energy accumulated in case of a crash from being transmitted directly onto the undercarriage of the vehicle, and in particular to prevent the undercarriage of the vehicle from being exposed to extreme stress and from possibly being damaged or even destroyed.

To protect the undercarriage of the vehicle from being damaged in connection with strong collision impacts, an energy consuming device having an energy consuming element with a destructive design is often used as so-called "shock absorber," designed, for example, in such a way that it responds as soon as the working consumption of the absorbing device is exhausted and that it at least partially absorbs and releases the energy transmitted via the energy consuming element as a result of the power flux. The energy consuming element can in particular be a deformation tube with which the impact energy introduced into the energy consuming device is converted into unit resilience and heat by way of (intended) plastic deformation in a destructive manner after a critical impact force has been exceeded.

A coupling arrangement comprising a central buffer coupling, a bearing bracket and an energy consuming device connected downstream of the bearing bracket is disclosed, for example, in the printed document DE 43 02 444 A1. The central buffer coupling comprises a gladhand as well as a coupling shaft supporting the gladhand in which an absorbing device for absorbing the tractive and impact forces occurring in regular driving mode and introduced into the gladhand is integrated. The end section of the coupling shaft on the vehicle side is flexibly retained in the bearing bracket joined with the undercarriage of the vehicle. A deformation tube is used as energy consuming device for the coupling arrangement disclosed in the prior art, which is resting on the bearing bracket of the coupling arrangement and is designed such that it responds when the operating load of the absorbing device integrated in the coupling shaft is exceeded and is pushed through a nozzle plate resting on the end section of the deformation tube on the vehicle side via axial shifting of the bearing bracket under the reduction of the cross-section.

On the one hand, the disadvantage of said solution is that a relatively large space is required in the undercarriage of the freight car body for the reverse motion of the bearing bracket together with the deformation tube, because the deformation tube is pushed through the nozzle plate into an additionally required space behind the coupling arrangement when the deformation tube is deformed, i.e., when the energy consuming device responds. For coupling arrangements in which said additional space is not available, for instance because of the immediate vicinity of a bogie, it will not be possible to use the solution for the energy consuming device proposed in said prior art.

However, the solution disclosed in the printed document DE 43 02 444 A1 is in particular associated with the risk that the deformation tube, for example in the cone-shaped bore hole formed in the nozzle plate, tends to "seize up" or become wedged when the energy consuming device responds—especially in connection with a vertical or inclined load of the deformation tube, such that the function of a destructive energy consumption is no longer given.

More broadly speaking, the known energy consuming devices, such as ones described above, are associated with the basic risk that components which shift relative to the undercarriage of the vehicle in the direction of the vehicle in case of a crash jam during said axial displacement, whereby the achievable energy consumption is indefinite and in particular no previously definable course of events is given in connection with the energy consumption. In detail, the risk associated with the solution described in DE 43 02 444 A1 is that the deformation tube itself, which is axially displaced toward the vehicle or freight car body together with part of the bearing bracket in this solution, becomes wedged or jammed or seizes up in the opening provided in the nozzle plate in case of a crash.

BRIEF SUMMARY

Based on this problem, the present invention is based on the task to upgrade a coupling arrangement of the type mentioned above to the extent that a maximum energy consumption can be realized in case of a crash with a course of events definable in advance. In particular, the task is to specify a coupling arrangement in which the accumulated impact energy can at least be partly released according to a defined and pre-specifiable course of events.

Said task is solved with the object of the independent patent claim 1.

In particular, the task of the invention is solved in that the coupling arrangement of the type mentioned above comprises a supporting structure having two longitudinal beams each arranged on the sides of the central buffer coupling to limit a horizontal deflection of the central buffer coupling and a crossbeam, wherein said crossbeam is arranged above the central buffer coupling in such a way that a vertical deflection of the coupling shaft is limited by the crossbeam relative to the undercarriage of the vehicle, wherein the crossbeam is joined with the two longitudinal beams in such a way that vertical forces applied from the central buffer coupling onto the crossbeam are transmitted from the crossbeam to the two longitudinal beams.

The advantages achievable with the proposed solution are obvious: by providing the supporting structure consisting of the collateral longitudinal beams and the crossbeam arranged above the central buffer coupling, it can be prevented in an easy to realize yet effective manner that the central buffer coupling veers upward or toward the side in a vertical direction, in particular in case of a crash. In addition, it is made sure that the forces applied from the central buffer coupling onto the crossbeam are absorbed by the two collateral longitudinal beams. This makes it possible in particular to provide an energy consuming device allocated to the crossbeam with at least one energy consuming element with a destructive design, which is designed such that it responds when a critical impact force defined in advance applied to the crossbeam is exceeded and that it releases at least part of the energy generated in connection with the transmission of the impact force and introduced into the energy consuming device via the crossbeam, via plastic deformation with the simultaneous translational motion of the crossbeam relative to the two longitudinal beams in the direction of the vehicle.

In particular, the solution according to the invention ensures that climbing forces of the central buffer coupling are transmitted to the undercarriage of the vehicle via the supporting structure, and in particular via the collateral support elements of the supporting structure, wherein said climbing forces are no longer—such as is the case with solutions known from the prior art—transmitted into the energy consuming element of the energy consuming device allocated to (and connected downstream of) the central buffer coupling. This ensures that only essential axial forces are introduced into the at least one energy consuming element of the energy consuming device allocated to the central buffer coupling, such that jamming of components of the central buffer coupling in connection with its longitudinal motion relative to the undercarriage of the vehicle is no longer possible once the energy consuming device has responded. Consequently, this achieves that the course of events of the energy consumption overall is foreseeable in case of a crash. For instance, if a deformation tube is used as energy consuming element, this achieves in particular that the plastic deformation of the deformation tube, i.e., either the plastic enlargement or reduction of the cross-section of the deformation tube, takes place in a foreseeable manner.

If a vehicle combination is involved in a crash, that is, if a vehicle equipped with the coupling arrangement according to the invention is joined with an adjacent vehicle, also equipped with the coupling arrangement according to the invention, then the supporting structure of the coupling arrangement additionally effectively prevents an overriding motion of the two adjacent vehicles, because an unintended vertical deflection of the coupling shaft is prevented by the crossbeam of the supporting structure. In addition, collateral swerving of the coupling shaft is prevented by the longitudinal beams arranged on the sides of the central buffer coupling.

Advantageous upgrades of the solution according to the invention are described in the sub-claims.

For example, with respect to the energy consuming device allocated to the central buffer coupling, it is intended that the associated energy consuming element is designed as deformation tube having a first deformation tube section on the side of the vehicle or freight car body and a second deformation tube section on the opposite side, wherein the second deformation tube section has a wider cross-section compared to the first deformation tube section and can be joined with the undercarriage of the vehicle via a bearing bracket.

In said exemplary embodiment of the energy consuming device allocated to the central buffer coupling, a tapered ring arranged at the transition between the first and the second deformation tube section is additionally used, which cooperates with a power transmission element joined or joinable with the coupling shaft of the central buffer coupling via the bearing of the central buffer coupling in such a way that an impact force applied to the central buffer coupling is transmitted into the first deformation tube section via the coupling shaft, the bearing of the central buffer coupling and via the power transmission element and the tapered ring. Once the energy consuming device has responded, i.e., as soon as the central buffer coupling together with the power transmission element and the tapered ring moves toward the direction of the freight car body, the tapered ring causes a plastic expansion of the still unexpanded first deformation tube section. By providing a tapered ring in the transition area between the already expanded (second) deformation tube section and the still unexpanded (first) deformation tube section, it is in particular possible to realize a particularly high and ideally complete force application from the power transmission element and the tapered ring into the transition segment of the deformation tube, whereby the response time and the response behavior of the energy consuming device on the one hand and the course of events associated with the energy consumption on the other hand, i.e., after the response of the energy consuming device allocated to the central buffer coupling, can be precisely defined in advance.

On the other hand, an energy consuming device can be provided by incorporating an energy consuming element designed as a deformation tube which is connected downstream of the central buffer coupling and is designed such that it is plastically deformed with the expansion of the cross-section once the operating load of the central buffer coupling has been exceeded, said energy consuming device allowing a maximum energy consumption while the installation space is as small as possible. This is achieved in that the deformation tube is not thrust out into a space additionally provided, for example in the undercarriage of the freight car body, when the energy consuming device responds.

With respect to the energy consuming device allocated to the central buffer coupling, it is obviously also conceivable to use a deformation tube for this purpose which consumes or releases at least part of the accumulated impact energy as a result of the plastic reduction of the cross-section, i.e., converts it into thermal energy and unit resilience.

In an exemplary upgrade of the last mentioned embodiment, an absorbing device having an absorbing element with a regenerative design is additionally allocated to the central buffer coupling in order to absorb tractive and/or impact forces applied to the gladhand of the central buffer coupling during regular driving mode. In so doing, it is conceivable that the absorbing device is integrated into the coupling shaft of the central buffer coupling between the gladhand and the bearing via which the coupling shaft is pivotably joined.

However, to reduce the installation space for the coupling arrangement, it is advantageous if the absorbing device having an absorbing element with a regenerative design and used to absorb the tractive and impact forces occurring in regular driving mode is integrated in the energy consuming device. In the process, the absorbing device should be designed and integrated in the energy consuming device in such a way that the power flux associated with the impact power transmission runs through both the absorbing device and the energy consuming element. Consequently, according to the general principles of the present invention, the absorbing element being part of the absorbing device should be connected in parallel with the energy consuming element belonging to the energy consuming device. In particular, this means that the energy consuming element is not connected downstream of the energy consuming device of the absorbing device, such as is the case with solutions known from the prior art.

As a result of the fact that the absorbing element of the absorbing device is connected in series with the energy consuming element of the energy consuming device in said exemplary embodiment, it can be achieved in an advantageous manner that the overall length of the coupling arrangement and hence the installation space to be provided in the undercarriage of the vehicle can be reduced considerably.

According to another advantageous embodiment of the coupling arrangement according to the invention, an energy consuming device having at least one energy consuming element with a destructive design allocated to the crossbeam of the supporting structure is provided in addition to the energy consuming device allocated to the central buffer coupling. This at least one energy consuming element is designed such that it responds as soon as a critical impact force definable in advance applied to the crossbeam is exceeded and that it releases at least part of the energy accumulated during the impact power transmission and applied to the corresponding allocated energy consuming device by way of plastic deformation, with the simultaneous longitudinal motion of the crossbeam relative to the two longitudinal beams of the supporting structure in the direction of the vehicle. By providing an additional energy consuming device allocated to the crossbeam, it is possible to increase the maximum energy uptake in case of a crash to help better protect the undercarriage of the vehicle.

In an exemplary realization of the last mentioned embodiment, in which an energy consuming device allocated to the crossbeam is provided in addition to the energy consuming device allocated to the central buffer coupling, the coupling arrangement moreover comprises at least one linear bearing via which the crossbeam is joined with at least one of the two longitudinal beams. In at least one embodiment, at least two linear bearings are provided via which the crossbeam is joined with the two longitudinal beams of the supporting structure. The at least one or the at least two linear bearings is/are designed such that it/they only allow(s) the longitudinal motion of the crossbeam relative to the two longitudinal beams after the response of the at least one energy consuming element of the energy consuming device allocated to the crossbeam.

The term "linear bearing" used herein refers to a component that only allows motion in the longitudinal direction of the coupling arrangement and prevents motions in the vertical direction hereto. In the present case, the at least one linear bearing serves in particular for guiding a straight (translational) motion of the crossbeam relative to the two longitudinal beams of the supporting structure if the impact force critical with respect to the energy consuming device allocated to the crossbeam has been exceeded and the energy consuming device allocated to the crossbeam has responded.

The provision of at least one linear bearing via which the crossbeam is joined with the two longitudinal beams ensures that the crossbeam can be moved toward the direction of the vehicle in case of a crash without losing its actual function, namely the restriction of a vertical excursion of the coupling shaft relative to the undercarriage of the vehicle.

The at least one linear bearing is designed as a linear guide rigidly joined with at least one of the two longitudinal beams of the supporting structure. This allows a pre-definable translational motion of the crossbeam relative to the longitudinal beams. In particular, it is also conceivable to use a guide sleeve rigidly joined with at least one of the two longitudinal beams of the supporting structure or a guide ring rigidly joined with at least one of the two longitudinal beams as linear bearing. Other embodiments are obviously also possible.

In an upgrade of the last mentioned embodiment of the coupling arrangement according to the invention, at least one limit stop rigidly joined with at least one of the two longitudinal beams is provided to limit the translational motion of the crossbeam relative to the two longitudinal beams in the direction of the vehicle. In so doing, it is conceivable that, for instance, the at least one linear bearing designed as linear guide comprises a face on the coupling side, wherein the previously mentioned at least one limit stop is formed by the face on the coupling side of said linear guide.

With respect to the at least one of the two longitudinal beams, the at least one limit stop should be arranged in such a way that the face on the coupling side of the crossbeam and the face on the coupling side of the at least one of the two longitudinal beams are positioned in a common vertical plane if the crossbeam is moved maximally in the direction of the vehicle relative to the two longitudinal beams.

With respect to the energy consuming device allocated to the crossbeam, it is provided that at least one energy consuming element is designed as a deformation tube having a first deformation tube section on the vehicle side and a second deformation tube section on the opposite side, wherein the second deformation tube section has an expanded cross-section compared to the first deformation tube section. Similar to the exemplary embodiment of the energy consuming element of the energy consuming device allocated to the central buffer coupling described above, it is advantageous for the energy consuming element of the energy consuming device allocated to the crossbeam, if a tapered ring is provided at the transition between the first and the second deformation tube section which cooperates with a power transmission element joined or joinable with the crossbeam in such a way that an impact force applied to the crossbeam is transmitted into the first deformation tube section via the power transmission element and the tapered ring Said power transmission element joined or joinable with the crossbeam should be retained in at least one linear bearing, for example in a linear bearing as described above, in order to ensure a guided translational motion of the crossbeam relative to the longitudinal beams. Furthermore, it is advantageous if the second deformation tube section of the energy consuming element designed as deformation tube of the energy consuming device allocated to the crossbeam is rigidly joinable with the undercarriage of the vehicle via a corresponding bearing bracket.

The advantages resulting from the use of a deformation tube of the type mentioned above as energy consuming element of the energy consuming device allocated to the crossbeam have already been described in connection with the energy consuming element of the energy consuming device allocated to the central buffer coupling. In particular, it allows the realization of a maximum energy consumption in connection with a foreseeable course of events and a small installation space.

For the particularly effective prevention of an overriding motion of two adjacent freight car bodies in case of a crash, it is advantageous if the crossbeam and/or the two longitudinal beams of the supporting structure comprise an override protector each on the corresponding sides facing the gladhand. These can in particular be horizontal braces which bring about the wedging of the adjacent freight car bodies.

With respect to the two longitudinal beams of the supporting structure, it is provided that they are each joinable with the undercarriage of the vehicle via a corresponding allocated bearing bracket, wherein the end section on the side of the freight car body of the two longitudinal beams is retained by the corresponding allocated bearing bracket and joined with the bearing bracket via at least one shearing/tear-off element. Each of the two bearing brackets allocated to the longitudinal beams is designed as linear bearing in such a way that it allows a longitudinal motion (translational motion) of the longitudinal beam relative to the undercarriage of the vehicle after the at least one shearing/tear-off element has failed or responded, respectively.

In this context, it is in particular conceivable that each of the two bearing brackets allocated to the longitudinal beams comprises a sleeve-shaped linear guide which retains one end section of the corresponding longitudinal beam in a telescope-like fashion. Accordingly, if a critical impact force is applied to the longitudinal beam of the supporting structure in the direction of the vehicle in case of a crash and the corresponding shearing/tear-off elements fail, a translational motion of the two longitudinal beams relative to the undercarriage of the vehicle guided by the bearing brackets designed as linear guide will take place.

Finally, in an exemplary realization of the coupling arrangement according to the invention, it is also provided that the latter comprises a supporting device for vertically supporting the coupling shaft of the central buffer coupling, wherein the supporting device comprises a support arranged underneath the central buffer coupling and which is or can be brought in contact with the coupling shaft as well as a holder joined with the support and attached on the two longitudinal beams via a transverse web.

In so doing, it is advantageous if the holder comprises a joining element via which the support is joined with the holder, wherein said joining element defines a rotational axis around which the support can be rotated relative to the joining element. Furthermore, it is advantageous if at least one shearing element is provided which joins the joining element with the support and is designed such that a torque transmitted from the support to the joining element via the at least one shearing element is sheared off if a pre-defined or definable amount has been exceeded, in order to allow a rotation of the support relative to the joining element.

By providing said type of joining element to a supporting device as vertical support of the coupling shaft of the central buffer coupling, that is, one which defines a rotational axis around which the support can rotate relative to the joining element, it is possible if needed and in particular in case of a crash or if the operating load of the coupling has been exceeded, to turn the support away via the rotational axis defined with the joining element into a position in which the support has no negative impact with respect to the motion of the central buffer coupling in the direction of the freight car body. In detail, it is proposed to provide at least one shearing element which joins the joining element with the support and is designed such that the torque transmitted from the support to the joining element via the at least one shearing element is sheared off if a predefined or definable amount is exceeded and thus allows the rotation of the support via rotational axis defined with the joining element relative to the joining element.

The term "shearing element" as used herein relates to any component that serves as power transmission link for the transmission of forces and torques up to a maximum shear stress acting on the component and shears off when or after the maximum shear stress has been exceeded and hence loses its power transmission function on the one hand and its joining function on the other hand. For the at least one shearing element used in the supporting device, it is advantageous if the shearing strength of said shearing element is defined in advance in such a way that the shearing off of the shearing element only occurs if the pre-defined critical torque is transmitted from the support to the joining element via the at least one shearing element. A critical torque occurs, for instance, if the gladhand attached on the end of the side of the coupling plane of the coupling rod hits the support of the supporting device due to the longitudinal displacement of the central buffer coupling in the direction of the freight car body in case of a crash.

Thanks to the fact that the solution of the supporting device proposed herein allows a rotation of the support relative to the joining element when the at least one shearing element responds, the supporting device can be turned downward away from the coupling rod, such that no interfering components are obstructing a longitudinal displacement of the coupling in the direction of the freight car bodies. The supporting device pushed out of the displacement path of the coupling continues to remain rigidly joined with the two longitudinal beams of the supporting structure and hence with the undercarriage of the vehicle via holder of the supporting device such that the trackbed is kept unobstructed and no components fall off the supporting device.

One exemplary embodiment of the coupling arrangement according to the invention is described below with reference to the enclosed drawings.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 1:
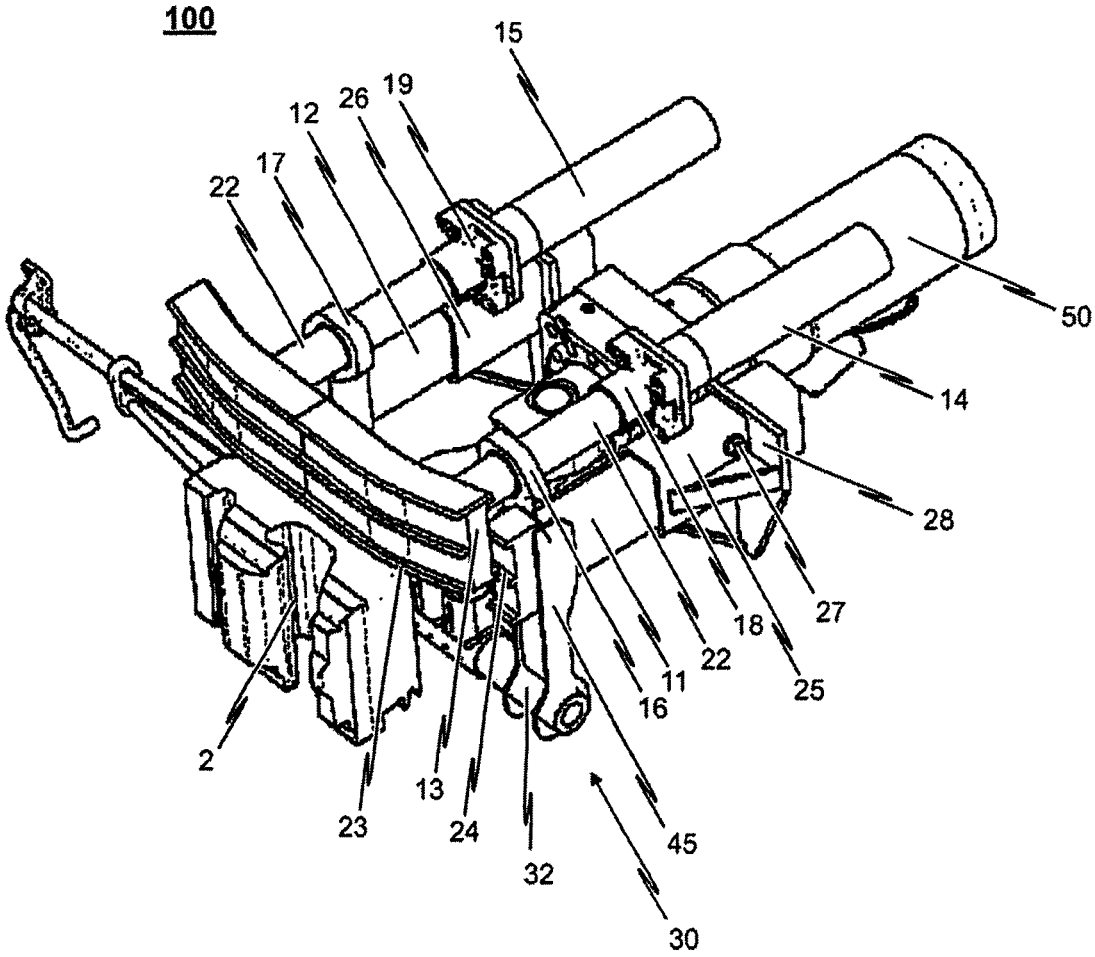
FIG. 1 shows a perspective representation of an exemplary embodiment of the coupling arrangement according to the invention.
Figure 6:
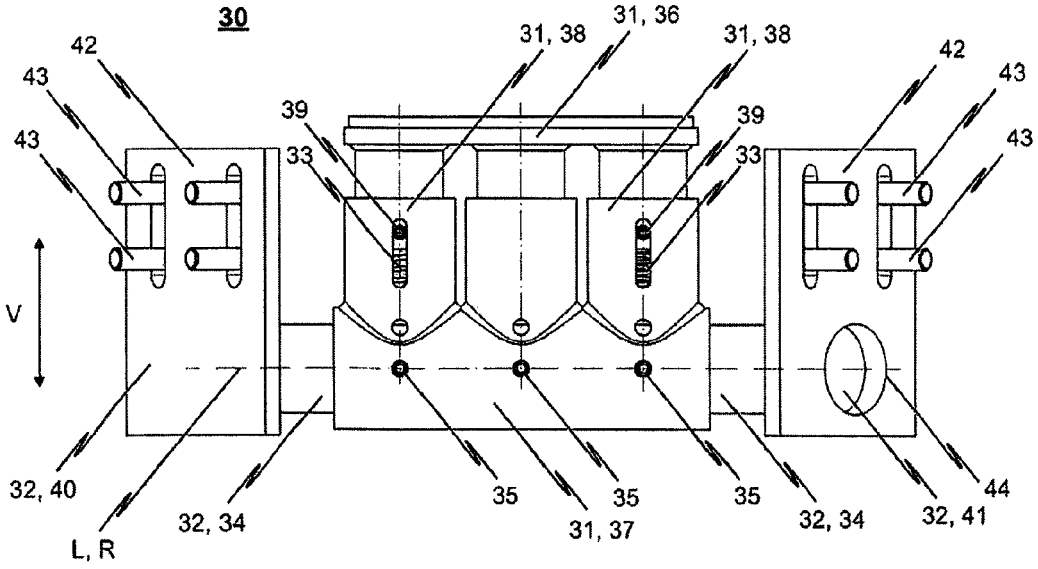
FIG. 6 shows a supporting device used in the coupling arrangement according to FIG. 1 in a schematic single view of the side of the supporting device pointing in the direction of the freight car body.
Figure 8A:
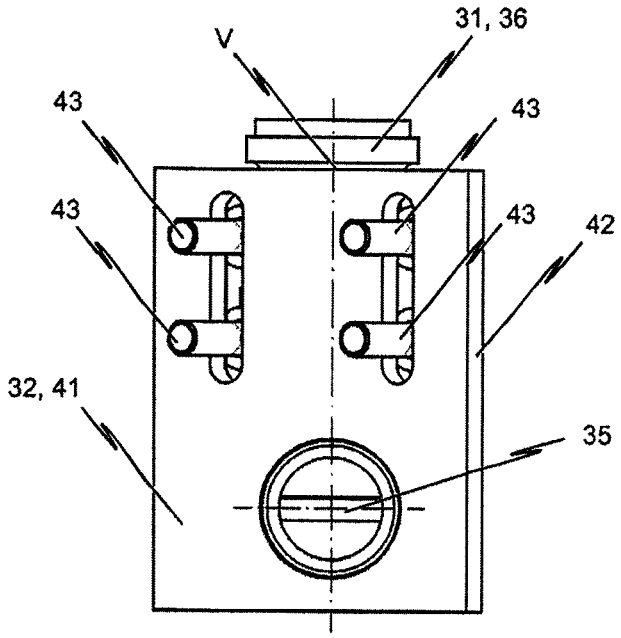
Figure 8B:
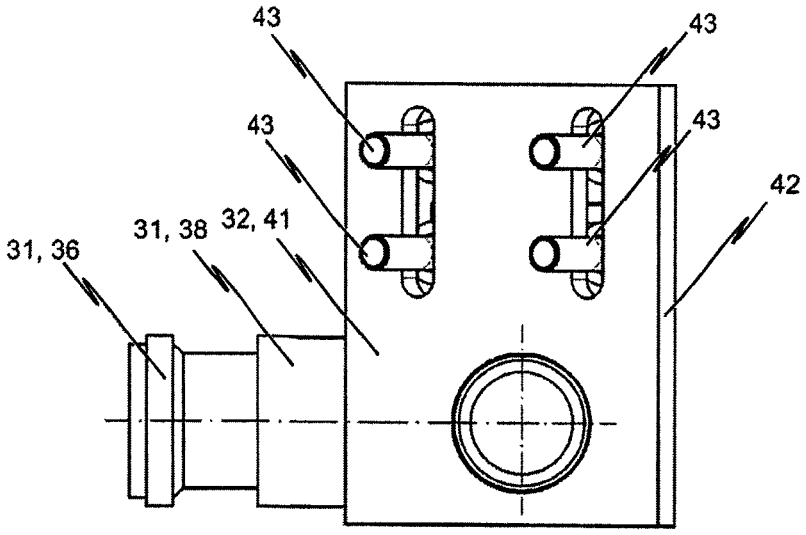
Figure 9:
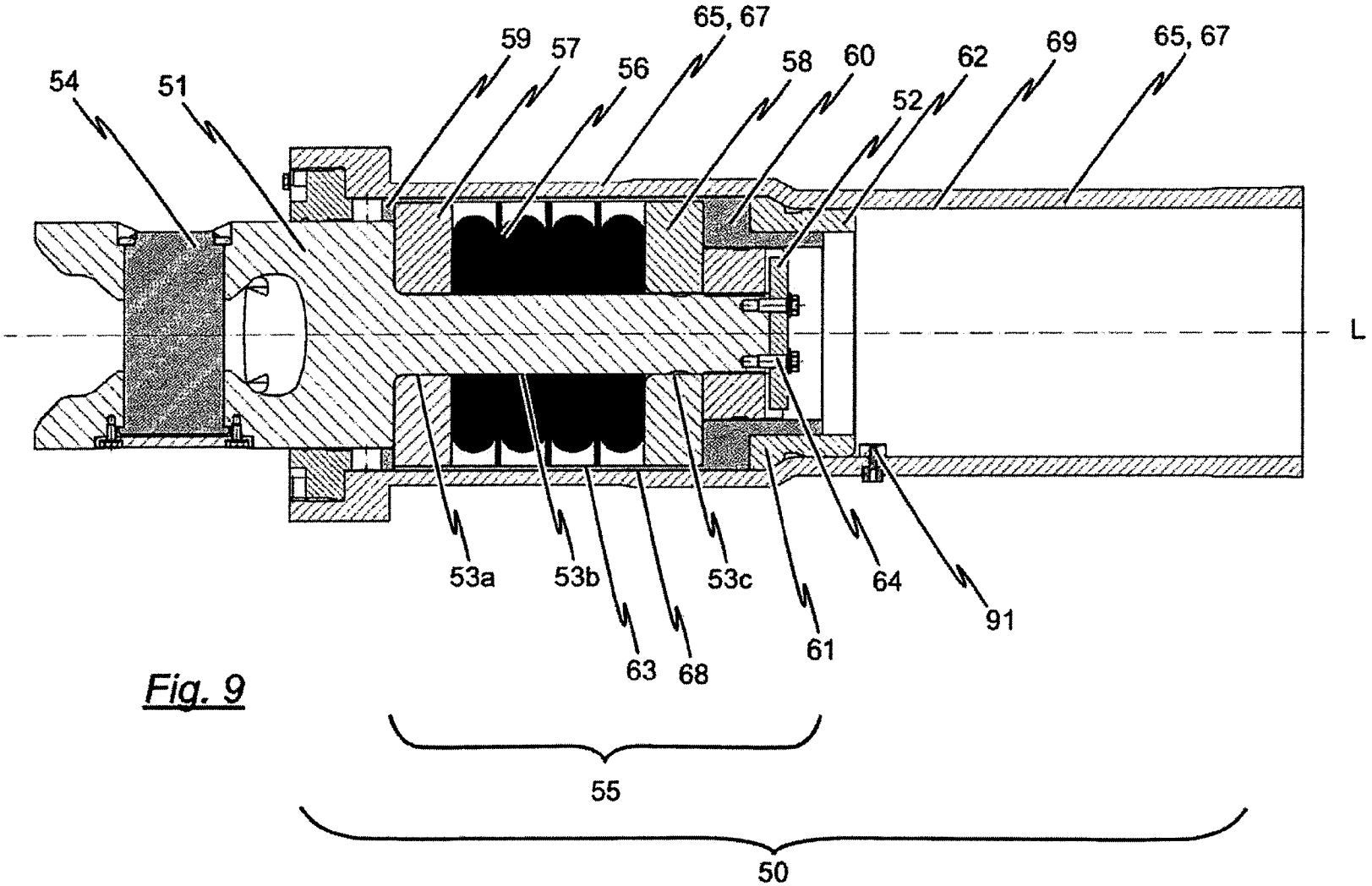

FIG. 8*a* shows a schematic side view of the supporting device according to FIG. 6 in stand-by mode;

FIG. 8*b* shows a schematic side view of the supporting device according to FIG. 6 after the support has been pivoted; and FIG. 9 shows a longitudinal section of the energy consuming device used for the coupling arrangement according to FIG. 1 and allocated to the central buffer coupling.

DETAILED DESCRIPTION OF VARIOUS EMBODIMENTS

Various embodiments now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Below is a description of the design and functionality of an exemplary embodiment of the coupling arrangement 100 according to the invention, with reference to the illustrations in FIGS. 1 to 5.

Figure 3:
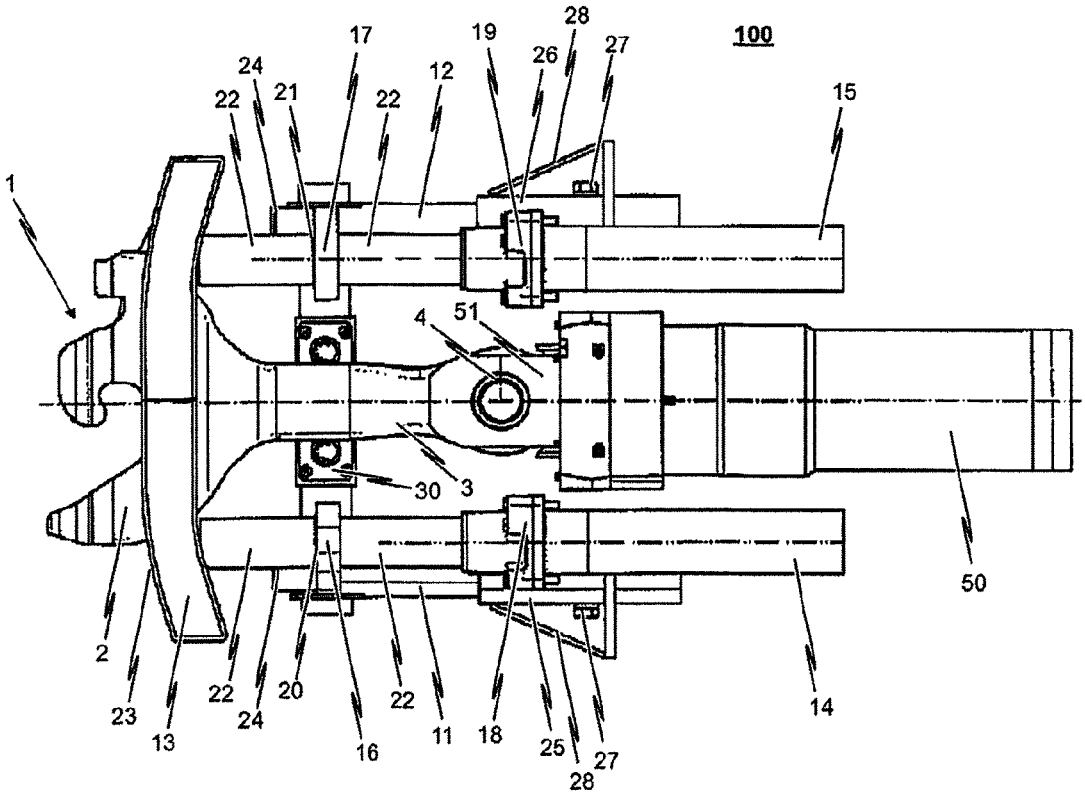
FIG. 3 shows a top view of the coupling arrangement according to FIG. 1.

As is best visible by the representation in FIG. 3, the purely exemplary illustration of the coupling arrangement 100 comprises a central buffer coupling 1 having a gladhand 2 and a coupling shaft 3 supporting the gladhand 2. The central buffer coupling 1 is an automated or semi-automated central buffer coupling, for instance of the AAR type.

As described in more detail below with reference to the illustration in FIG. 9, the end section of the coupling shaft 3 on the side of the freight car body or the vehicle is pivotably joined in horizontal and vertical direction with a power transmission element 51 by way of a bearing 4. For this purpose, the power transmission element 51 is designed as a fork at its end at the level of the coupling side, said fork being used to retain a corresponding complementary eye attached on the end section of the coupling shaft 3 on the side of the freight car body. The fork and the eye retained with the fork are pivotably supported in the horizontal plane by means of a pivotable bolt 5, wherein a vertical deflection of the coupling shaft 3 relative to the power transmission element 51 is additionally guaranteed. This ensures, for instance, that a difference in height between two joined freight car bodies occurring during regular driving mode can be evened out.

As described in more detail below with reference to the illustration in FIG. 9, the purpose of the power transmission element 51 is to introduce tractive and impact forces applied to the central buffer coupling into an energy consuming device 50 allocated to the central buffer coupling 1, in which energy consuming device said forces are at least partially absorbed or released. The energy consuming device 50 allocated to the central buffer coupling 1 is joinable with the undercarriage of the vehicle (not illustrated) by way of a bearing bracket 70.

Moreover, a supporting structure 10 is provided with the exemplary embodiment of the coupling arrangement 100 according to the invention, which in particular serves the purpose of preventing a vertical swerving of the central buffer coupling 1 in case of a crash when impact forces are introduced into the central buffer coupling 1, such that the impact energy at least partially to be released within the energy consuming device 50 allocated to the central buffer coupling 1 is introduced into the energy consuming device 50 as axially as possible.

For this purpose, it is intended that the supporting structure 10 comprises two longitudinal beams 11, 12 each arranged on the sides of the central buffer coupling 1 as well as a crossbeam 13 joined with the two longitudinal beams 11, 12. The crossbeam 13 is arranged in such a way above the central buffer coupling 1 that the crossbeam 13 limits a vertical deflection of the coupling shaft 3 relative to the undercarriage of the vehicle. In detail, as can be gathered from the side view according to FIG. 2, the distance between the crossbeam 13 and the gladhand 2 of the central buffer coupling 1 is only as small as to merely allow the vertical motion of the coupling shaft relative to the undercarriage of the vehicle occurring in driving mode.

Figure 4:
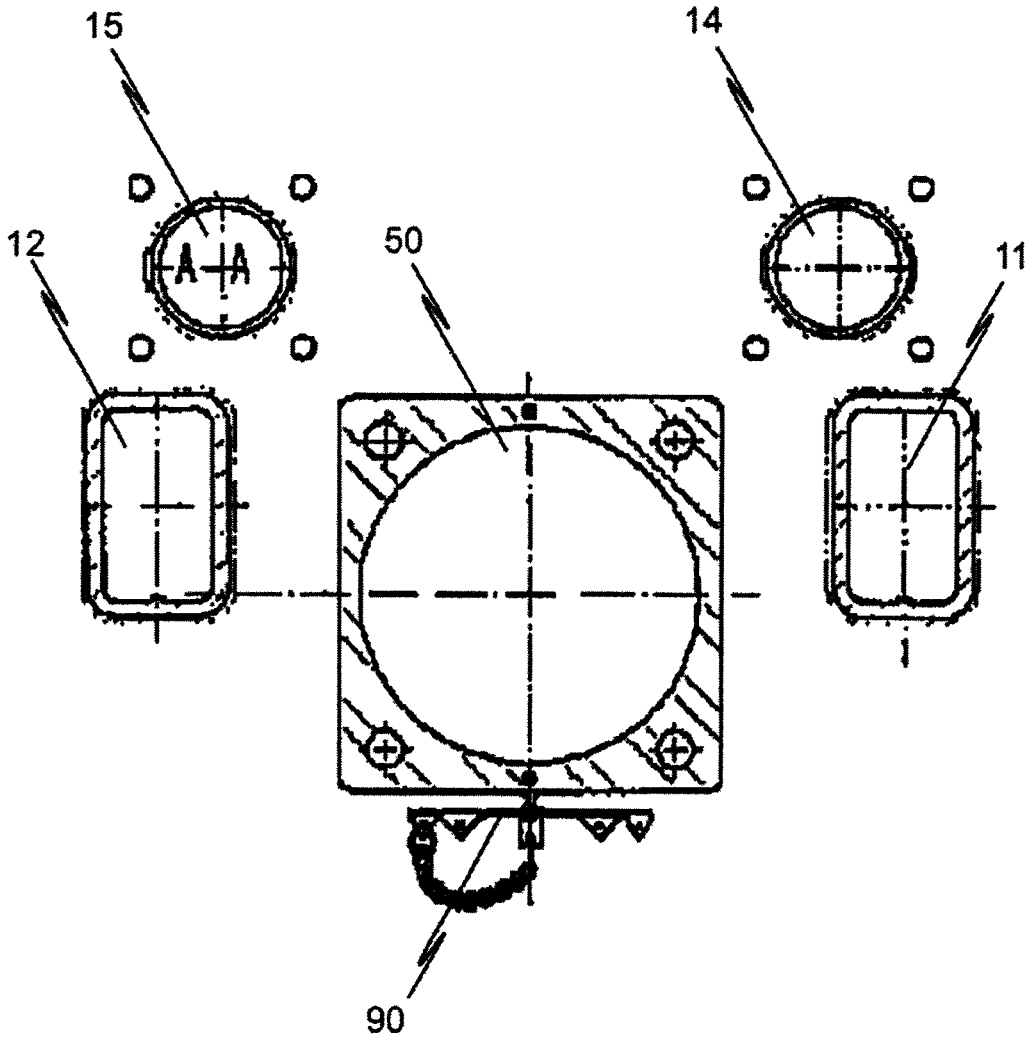
FIG. 4 shows a side view along the line A-A in FIG. 2.

As illustrated in the side view of FIG. 4, the longitudinal beams 11, 12 arranged on the side of the central buffer coupling 1 are essentially profiles that comprise, for example, a rectangular cross-section, and which are arranged in the longitudinal direction of the coupling arrangement 100 parallel to the energy consuming device 50 allocated to the central buffer coupling 1. Specifically, and as can be gathered in particular from the illustration in FIG. 1, a bearing bracket 25, 26 is allocated to each of the two longitudinal beams 11, 12, wherein said bearing brackets 25, 26 serve the purpose of joining the corresponding allocated longitudinal beams 11, 12 with the undercarriage of the vehicle in regular driving mode. The end sections of the respective longitudinal beams 11, 12 on the side of the freight car body are retained by the allocated bearing bracket 25, 26 and joined with the bearing bracket 25, 26 by way of at least one shearing/tear-off element 27.

The opposing end sections of the longitudinal beams 11, 12 are each equipped with an override protector 24, which is essentially formed with braces running horizontally. As described in more detail below with reference to the force-distance diagram illustrated in FIG. 5, said override protector 24 only comes into operation after the energy consuming device 50 allocated to the central buffer coupling 1 has responded.

Similar to the faces on the side of the coupling plane of the two longitudinal beams 11, 12 arranged on the side of the central buffer coupling 1, the face on the side of the coupling plane of the crossbeam 13 is also equipped with an override protector 23 designed as braces running horizontally.

In the illustrated exemplary embodiment of the coupling arrangement 100 according to the invention, the crossbeam 13 is not joined directly with the collateral longitudinal beams 11, 12 of the supporting structure 10. In fact, two collateral power transmission elements 22 (pistons) are provided on the end section on the side of the freight car body of the crossbeam 13, whose end section on the side of the freight car body ends in an energy consuming device 14, 15 allocated to the crossbeam 13. Said two energy consuming devices 14, 15 allocated to the crossbeam 13 are in turn joinable with the undercarriage of the vehicle via corresponding bearing brackets 18, 19.

As can be gathered in particular from the illustration in FIG. 1, a bearing 16, 17 designed as a linear guide is attached on each of the two collateral longitudinal beams 11, 12 of the supporting structure 10, with the corresponding power transmission element 22 running through said bearing. The collateral power transmission elements 22 of the crossbeam 13 and hence the crossbeam 13 are joined with the corresponding longitudinal beams 11, 12 of the supporting structure 10 by way of these bearings 16, 17 each designed as linear guide.

The two energy consuming devices 14, 15 allocated to the crossbeam 13 are ones for which an energy consuming element with a destructive design is used, which responds after a critical impact force introduced via the corresponding power transmission element 22 has been exceeded and releases at least part of the impact energy by way of plastic deformation, i.e., converts it into thermal energy and unit resilience.

Although not shown in the drawings, an energy consuming element designed as a deformation tube is used for the two energy consuming devices 14, 15 allocated to the crossbeam 13, wherein said deformation tube comprises a first deformation tube section on the side of the freight car body and a second deformation tube section on the opposite side, wherein the second deformation tube section has a wider cross-section compared to the first deformation tube section. Furthermore, a tapered ring arranged at the transition between the first and the second deformation tube section is provided, which cooperates with the power transmission element 22 joined with the crossbeam 13 and is retained in the corresponding bearing 16, 17 designed as linear guide in such a way that an impact force introduced into the crossbeam 13 is transmitted into the first deformation tube section of the corresponding energy consuming device 14, 15 via the power transmission element 22 and the tapered ring.

Accordingly, the two energy consuming devices 14, 15 allocated to the crossbeam 13 have a design that is comparable in principle with the design of the energy consuming device 50 illustrated in FIG. 9 and allocated to the central buffer coupling 1. The only difference is that in addition to the energy consuming element 65 with a destructive design an absorbing element 56 is provided for the energy consuming device 50 allocated to the central buffer coupling 1, whereas said type of absorbing element is missing in the energy consuming devices 14, 15 allocated to the crossbeam 13.

Accordingly, the two energy consuming devices 14, 15 allocated to the crossbeam 13 only allow a translational motion of the crossbeam 13 in the direction of the freight car body relative to the undercarriage of the vehicle after the energy consuming devices 14, 15 have responded, i.e., after a critical impact force has been introduced into the corresponding energy consuming devices 14, 15 by way of the crossbeam 13 and the two collateral power transmission elements 22. Said translational motion of the crossbeam 13 relative to the undercarriage of the vehicle in the direction of the freight car body taking place in case of a crash is guided by the provision of the bearings 16, 17 designed as linear guides, because said bearings 16, 17 are rigidly joined with the collateral longitudinal beams 11, 12 of the supporting structure 10.

As explained earlier, the longitudinal beams 11, 12 are joined with the undercarriage of the vehicle by way of corresponding bearing brackets 25, 26 and shearing/tear-off elements 27, wherein the bearing brackets 25, 26 comprise a corresponding flange area 28 for this purpose.

The guided translational motion of the crossbeam 13 relative to the longitudinal beams 11, 12 is preserved until the crossbeam hits a corresponding limit stop 20, 21. In the exemplary embodiment illustrated in the drawings, said limit stop 20, 21 is realized with the respective faces on the side of the coupling plane of the bearings 16, 17 designed as linear guides.

If the crossbeam 13 hits the limit stop 20, 21, no further translational motion of the crossbeam relative to the collateral longitudinal beams 11, 12 of the supporting structure 10 is possible. In this status, the face on the gladhand side of the crossbeam 13 and the faces on the gladhand side of the two collateral longitudinal beams 11, 12 are positioned in a common vertical plane, as can be gathered from the dashed line in FIG. 2. The face of the crossbeam 13 and the faces of the two longitudinal beams 11, 12 then form a contact area such that the override protector 23 of the crossbeam 13 as well as the override protector 24 of the longitudinal beams 11, 12 can cooperate (engage) with the corresponding components of an adjacent freight car body in such a way that overriding of the adjacent freight car body is prevented.

If additional impact energy is introduced into the coupling arrangement in this status and specifically into the crossbeam 13 as well as into the collateral longitudinal beams 11, 12, the shearing/tear-off elements 27 which join the end sections on the side of the freight car bodies of the longitudinal beams 11, 12 with the corresponding allocated bearing brackets 25, 26 will fail. As can be gathered in particular from the illustration in FIG. 1, the bearing brackets 25, 26 are designed as linear guides and guide the translational motion of the longitudinal beams 11, 12 (as well as the translational motion of the crossbeam 13) in such a way that no wedging or jamming is possible after the shearing/tear-off elements 27 have failed. Simultaneously with the translational motion of the longitudinal beams 11, 12 in the direction of the freight car body, the central buffer coupling 1 is displaced in the direction of the energy consuming device 50 allocated to the central buffer coupling 1, as a result of which at least part of the impact energy introduced into the coupling arrangement 100 is consumed in the energy consuming device 50 allocated to the central buffer coupling 1.

Below is a detailed description of the design and functionality of the energy consuming device 50 allocated to the central buffer coupling 1 with reference to the illustration in FIG. 9.

Specifically, FIG. 9 contains a schematic longitudinal section of the energy consuming device 50 used in the exemplary embodiment of the coupling arrangement 100 and allocated to the central buffer coupling 1.

The energy consuming device 50 consists of an absorbing device 55 having a regeneratively designed absorbing element 56 in the form of spring-loaded elements, wherein said absorbing element 56 serves the absorption of tractive and impact forces occurring in regular driving mode and introduced into the central buffer coupling 1. In the exemplary embodiment of the coupling arrangement 100, said tractive and impact forces are introduced into the absorbing device 55 via the gladhand 2, the coupling shaft 3, the bearing 4 and the previously mentioned power transmission element 51.

As mentioned above, the power transmission element 51 is designed as a fork on its end on the side of the coupling plane and serves the purpose of retaining an eye formed on the end section on the side of the freight car body of the coupling shaft 3.

In addition to the absorbing device 55, the energy consuming device 50 allocated to the central buffer coupling 1 comprises an energy consuming element 65 with a destructive design. The purpose of said energy consuming element 65 is to respond as soon as a critical impact force defined in advance has been exceeded and to convert and hence consume at least part of the impact forces introduced into the energy consuming device 50 into heat and unit resilience by way of plastic deformation.

As illustrated in FIG. 9, the energy consuming element 65 of the energy consuming device 50 allocated to the central buffer coupling 1 is designed as a deformation tube comprising a first deformation tube section 66 on the side of the freight car body and a second deformation tube section 67 on the opposite side. The second deformation tube section 67 comprises a wider cross-section compared to the first deformation tube section 66. In the process, the absorbing device 55 is completely retained and integrated in the second deformation tube section 67 of the energy consuming element 65.

The absorbing device 55 comprises a first pressure plate 57 and a second pressure plate 58, with the absorbing element 56 arranged between them. When tractive and impact forces occurring in regular driving mode are introduced into the energy consuming device 50 or into the absorbing device 55 via power transmission element 51, the two pressure plates 57, 58 are moved relative to each other in the longitudinal direction L of the energy consuming device 50 with the simultaneous shortening of the distance between them.

In order to optimize the longitudinal displacement of the pressure plates 57, 58 in connection with the introduction of tractive and impact forces occurring in regular driving mode, the second deformation tube section 67 with the absorbing device 55 integrated in it comprises at least one guiding surface 68 which the two pressure plates 57, 58 interact with in such a way that the motion is guided analogously in the longitudinal direction L of the energy consuming device 50 if they are moved in longitudinal direction.

In the embodiment of the energy consuming device 50 allocated to the central buffer coupling 1 illustrated in FIG. 9, a first limit stop 59 allocated to the first pressure plate 57 as well as a second limit stop 60 allocated to the second pressure plate 58 are provided as mechanical stroke limit of the absorbing device 55. The longitudinal displaceability of the two pressure plates 57, 58 is limited with said two limit stops 59, 60.

As mentioned above, the energy consuming device 50 of the central buffer coupling 1 comprises a power transmission element 51, via which the tractive and impact forces introduced into the central buffer coupling 1 are introduced into the absorbing device 55. Said power transmission element 51 comprises an end section on the side of the freight car body, which passes through the first pressure plate 57, the absorbing element 56 and the second pressure plate 58 and comprises a counter element 52 on its end on the side of the freight car body. The counter element 52 cooperates with the second pressure plate at least in connection with the transfer of tractive forces, in order to transmit tractive forces from the power transmission element 51 to the second pressure plate 58. In the embodiment illustrated in FIG. 9, the counter element 52 is joined with the end section of the power transmission element 51 on the side of the freight car body by way of a screwed connection 64.

It is particularly advantageous if the end section of the power transmission element 51 on the side of the freight car body comprises a guiding surface which cooperates with corresponding guiding surfaces in the passages 53a, 53b, 53c of the two pressure plates 57, 58 and the absorbing element 56 and hence makes it possible to guide the pressure plates 57, 58 in connection with their longitudinal displacement in the longitudinal direction L of the energy consuming device.

In order to achieve that the impact forces introduced into the central buffer coupling 1 and passed on to the energy consuming device 50 via the power transmission element 51 can be introduced as uniformly as possible into the first deformation tube section 66 of the energy consuming element 65 designed as deformation tube, a tapered ring 61 is additionally provided at the transition between the first and the second deformation tube section 66, 67, which cooperates with the second limit stop 60 in such a way that the forces transmitted from the second pressure plate 58 to the second limit stop in connection with the impact power transmission are transmitted to the first deformation tube section 66 via the tapered ring 61. In the process, the tapered ring 61 comprises a guiding section 62, which at least partially extends into the first deformation tube section 66 and rests on the inner surface 69 of the first deformation tube section 66.

Furthermore, a prestress element 63 in the form of a guiding tube is provided which prestresses the second limit stop 60 against the tapered ring 61. Specifically, the prestress element 63 designed as guiding tube is joined with the second limit stop 60 on its end on the side of the freight car body and hits the first limit stop 69 with its opposing end, whereby a constant distance between the two limit stops 59, 60 is defined before the energy consuming element 65 of the energy consuming device 50 responds. In so doing, the prestress element 63 designed as guiding tube rests on the at least one guiding surface 68 of the second deformation tube section 67, wherein the first and second pressure plates 57, 58 are retained on the inside of the prestress element 63 designed as guiding tube and are movable in the longitudinal direction L of the energy consuming device 50 relative to the prestress element 63 designed as guiding tube in connection with a transmission of tractive or impact forces occurring in regular driving mode.

In the exemplary embodiment of the coupling arrangement 100 illustrated in the drawings, the energy consuming device 50 allocated to the central buffer coupling 1 is additionally provided with a deformation display 90, which indicates whether the energy consuming element 65 of the energy consuming device 50 has already responded. The deformation display 90 comprises a signal plate 92 which is joined with a block on the inside of the energy consuming element 65 designed as a deformation tube by way of a shearing bolt. Once the response strength of the deformation tube 65 has been reached, the tapered ring 61 shears the shearing bolt 91 through and the signal plate 92 hangs well visible on the undercarriage of the vehicle. This way, it can be determined easily and safely whether the deformation tube 65 of the energy consuming device 50 allocated to the central buffer coupling 1 has responded.

Below is a detailed description of the mode of action of the coupling arrangement 100 illustrated as an example in particular in the FIGS. 1 to 4, with reference to the force-distance diagram illustrated in FIG. 5.

Figure 5:
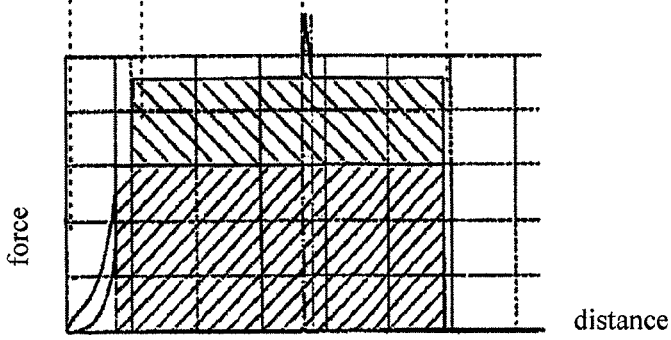
FIG. 5 shows a force-distance diagram of the coupling arrangement according to FIG. 1.

The first section in the distance-force diagram according to FIG. 5 reflects the flexible absorption behavior of the coupling arrangement 100. It indicates that when impact forces are introduced into the central buffer coupling 1 in driving mode, said impact forces are absorbed with the absorbing device 55. In so doing, the central buffer coupling 1 can be moved in the direction of the freight car body relative to the undercarriage by a defined distance, without one of the destructively designed energy consuming elements responding.

After the flexible absorbing behavior has been exceeded, the gladhand 2 continues to be positioned in a vertical plane which is located at a further distance away from the freight car body than the vertical plane in which the face of the crossbeam 13 is positioned.

If additional impact energy is introduced into the gladhand 2 in this status, the energy consuming element 65 of the energy consuming device 50 allocated to the central buffer coupling 1 responds, and the central buffer coupling 1 is displaced in the direction of the freight car body as a result, wherein the energy consuming element 65 is simultaneously subject to plastic expansion and hence releases part of the additional impact energy.

As soon as the gladhand 2 has been displaced in the direction of the freight car body relative to the undercarriage of the vehicle far enough that the face of the gladhand 2 and the face of the crossbeam 13 are positioned in a common vertical plane, the energy consuming devices 14, 15 allocated to the crossbeam 13 are triggered as well.

In so doing, the crossbeam 13 transmits part of the impact energy via the power transmission element 22 allocated to the crossbeam 13 such that said impact energy is introduced into the corresponding energy consuming devices 14, 15. At the same time, another part of the impact energy is introduced into the energy consuming device 50 allocated to the central buffer coupling 1 via the coupling shaft 3 and the power transmission element 51, where it is consumed by the energy consuming element 65.

As soon as the crossbeam 13 hits the limit stop 20, 21, part of the impact force introduced into the crossbeam 13 is introduced into the longitudinal beams 11, 12 via the bearings 15, 16 designed as linear guides, and the shearing/tear-off elements 27 fail as a result and the longitudinal beams 11, 12 are displaced in the direction of the freight car body together with the crossbeam 13 and the central buffer coupling 2. During said translational motion, part of the impact energy is released by the energy consuming devices 14, 15 allocated to the crossbeam 13 and the energy consuming element 65 of the energy consuming device 50 allocated to the central buffer coupling 1.

Figure 2:
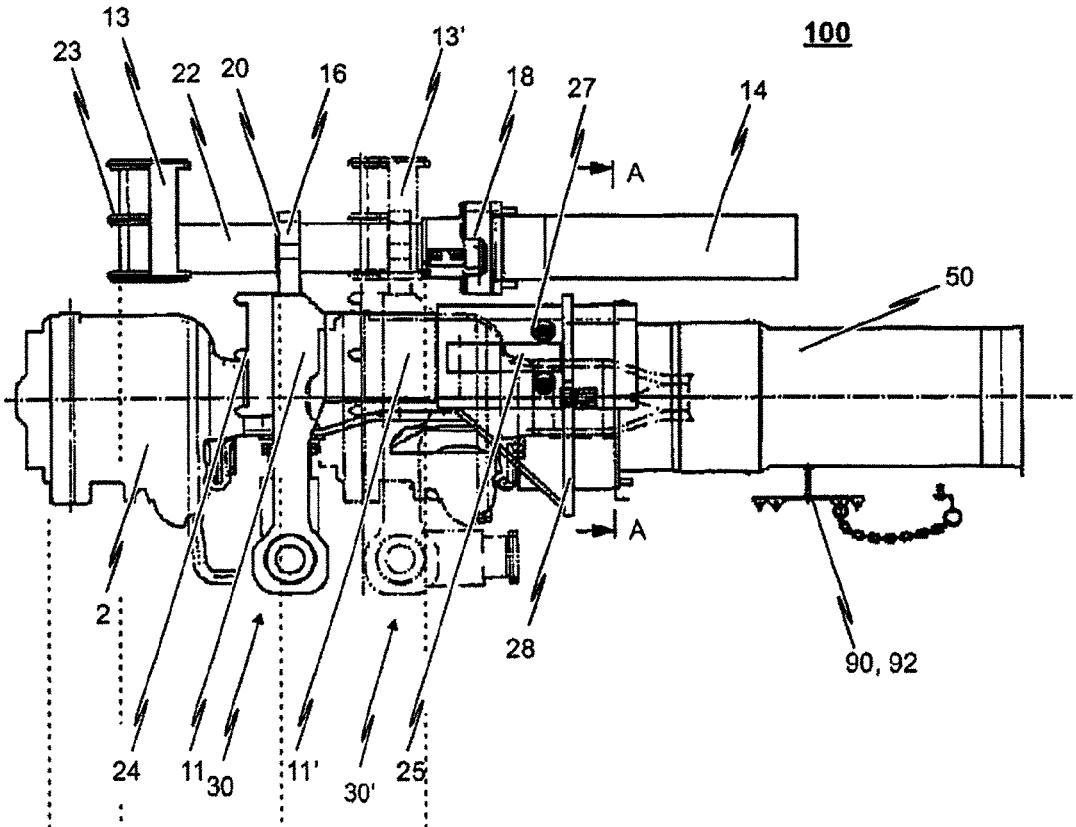
FIG. 2 shows a side view of the coupling arrangement according to FIG. 1.

As implied in the FIGS. 1 and 2, the exemplary embodiment of the coupling arrangement 100 according to the invention illustrated in the drawings furthermore comprises a supporting device 30, which is kinked when the energy consuming device 50 allocated to the central buffer coupling 1 responds and hence does not restrict the translational motion of the central buffer coupling 1 in the direction of the freight car body. The supporting device 30 is illustrated in FIG. 2 both in stand-by mode as well as in kinked status (indicated with the reference number 30').

Figure 7:
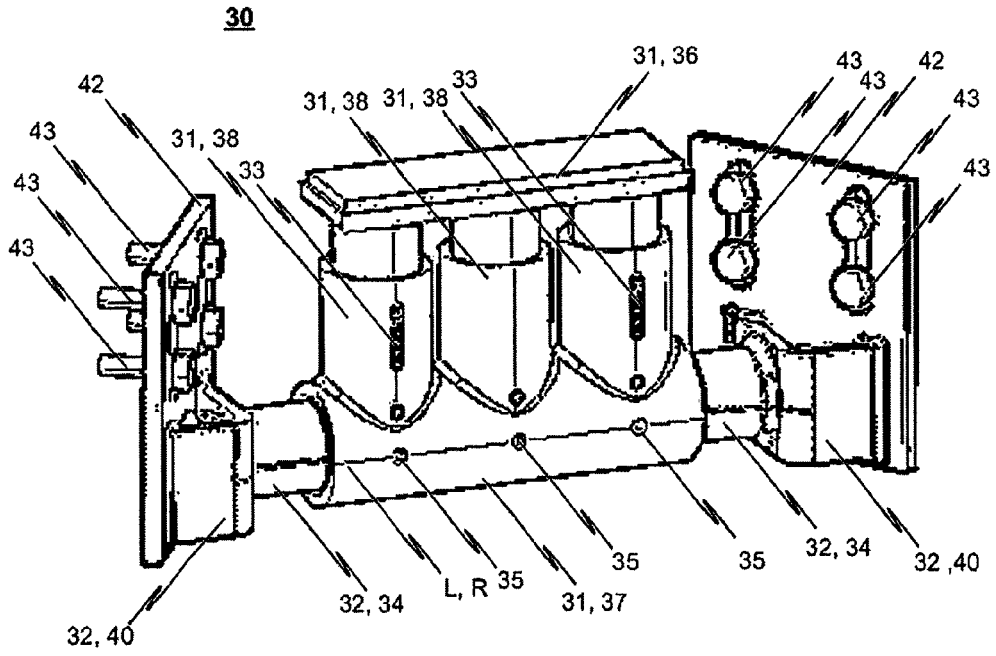
FIG. 7 shows a perspective representation of the supporting device according to FIG. 6 with a view of the side of the supporting device pointing toward the coupling plane.

FIG. 6 contains a schematic representation of an exemplary embodiment of the supporting device 30 according to the invention with a view of the side of the supporting device 30 pointing in the direction of the freight car body in assembled status. The illustration according to FIG. 7 shows the exemplary realization of the supporting device 30 according to the invention in a perspective view, namely onto the side of the supporting device 30 which points in the direction of the coupling plane in assembled status of the supporting device 30. FIG. 8*a* contains a schematic representation of a view of the exemplary realization of the supporting device 30 onto one side of the latter.

The illustrated supporting device 30 comprises a support 31 as well as a holder 32 joined with the support 31, said holder can be attached on one of the two longitudinal beams 11, 12 by way of a corresponding transverse web 45 as illustrated, for example, in FIG. 1. In the illustrated embodiment of the supporting device 30, the holder 32 comprises a joining element 34 designed as a rotationally symmetric pin. The support 31 is joined with the holder 32 by way of the joining element 34 designed as a rotationally symmetric pin.

Specifically, and as can be gathered in particular from the illustration shown in FIG. 6 or 7, the holder 32 comprises a total of two bearings 40, 41 which can be attached on a transverse web 45 rigidly joined with one of the two longitudinal beams 11, 12 by means of screws 43 as shown in the illustration according to FIG. 1. The joining element 34 is fixed on the two bearings 40, 41.

In the illustrated exemplary embodiment of the supporting device 30 according to the invention, the bearing 40 provided on the right side of the joining element 34 in FIG. 7 is designed as a fixed bearing by way of which the joining element 34 is fixed in all three translational degrees of freedom.

As mentioned above, the joining element 34 used in the illustrated embodiment of the supporting device 30 is designed as an elongated and rotationally symmetric pin, wherein one end of the joining element 34 is fixed on the fixed bearing 40 and the other end of the joining element 34 is fixed on a second bearing 41 arranged on the left side of the joining element 34 in FIG. 7. The other bearing 41 arranged on the left side in FIG. 7 is designed as a loose bearing via which the joining element 34 is only fixed in two translational degrees of freedom such that a motion in the direction of the axis of symmetry of the joining element 34 is given.

An opening 44 in a flange 42 is provided to realize the bearing 12 designed as a loose bearing of the supporting device 30 illustrated in the drawings, through which opening the joining element 34 can pass in the direction of the axis of symmetry L of the joining element 34. The opening 44 formed in the flange 42 can be seen in particular in the illustration of FIG. 6.

In the illustrated embodiment of the supporting device 30 according to the invention, the support 31 comprises a supporting piston 36 and a supporting body 37, wherein the supporting piston 36 is at least partially retained in sleeve-shaped elements 38 of the supporting body 37. Furthermore, flexible elements 33 in the form of spring-loaded elements are provided which are also retained in the sleeve-shaped elements 38 of the supporting body 37 and keep the supporting piston 36 at a distance from the supporting body 37 in a spring-loaded fashion.

The spring-loaded effect of the flexible spring-loaded elements 33 retained in the sleeve-shaped elements 38 of the supporting body 37 can be switched off and on as needed by means of a lock stop 39, for instance in the shape of a snap-in locking pin. Corresponding screws can be provided for this purpose with which the lock stop 39 can be activated.

Obviously, it is also conceivable that the lock stop 39 for immobilizing the supporting piston 36 and the supporting body 37 relative to each other is realized differently. Furthermore, it is also conceivable that the spring characteristic or the absorbing characteristic of the flexible spring-loaded element 33 can be set as needed even after the installation of the flexible spring-loaded element 33 in the supporting device 30.

The support 31 is essentially composed of the supporting piston 36 and the supporting body 37, wherein the supporting body 37 comprises the previously mentioned sleeve-shaped elements 38 for the retention of the flexible spring-loaded elements 33 on the one hand and for the partial retention of the supporting piston 36 on the other hand. In so doing, it is provided in an exemplary realization of the supporting device 30 according to the invention that the joining element 34, designed as an elongated, rotationally symmetric pin, passes through the supporting body 37 of the support 31 and is guided appropriately into the supporting body 37. In so doing, the supporting body 37 and the joining element 34 are joined in such a way that the supporting body 37 together with the supporting piston 36 is able to carry out a rotation relative to the joining element 34 around a rotational axis R. The rotational axis R is defined by the joining element 34 and—in particular in the illustrated exemplary realization of the supporting device 30 according to the invention—by the axis of symmetry L of the joining element 34 designed as a rotationally symmetric pin.

As can be gathered in particular from the illustrations shown in FIG. 6 and FIG. 7, the exemplary realization of the supporting device 30 according to the invention comprises shearing elements 35 which serve the purpose of joining the support 31 and in particular the supporting body 37 of the support 31 with the joining element 34 in a form-fitted fashion.

In the illustrated embodiment of the supporting device 30 according to the invention, the shearing elements 35 are designed as exchangeable shearing bolts or shearing pins, which join the support 31 and in particular the supporting body 37 of the support 31 with the joining element 34 guided through the supporting body 37 and hence fix the joining element 34 on the support 31.

As a result of the fact that the support 31 or the supporting body 37 with the supporting piston 36 is pivotable around the rotational axis R defined with the joining element 34 in the supporting device 30 according to the invention, essentially only shearing forces are effective in connection with a transmission of forces and in particular in connection with a transmission of dynamic forces between the support 31 and the holder 32 applied to the shearing elements 35, said shearing forces being induced by torques.

In detail, the shearing elements 35 are designed to shear off a torque transmitted from the support 31 to the joining element 34 via the shearing elements 35 once an amount defined or definable in advance has been exceeded, whereupon a rotation of the support 31 or the supporting body 37 together with the supporting piston 36 relative to the joining element 34 around the rotational axis R defined with the axis of symmetry L of the joining element 34 is made possible.

In FIG. 8*b*, the exemplary realization of the supporting device 30 is illustrated in a status after the shearing elements 35 have responded and a rotation of the support 31 relative to the joining element 34 has taken place.

The illustrations according to FIG. 8*b* show that the support 31 of the supporting device 30 can be rotated relative to the joining element 34 of the holder 32 around the rotational axis R defined with the joining element 34 after the shearing elements 35 have been sheared off.

Accordingly, the supporting device 30 according to the invention is in particular suitable for the vertical bracing of a central buffer coupling 1 or a coupling shaft 3 belonging to the central buffer coupling 1 if the central buffer coupling 1 has to be removed from the coupling plane, for instance in case of a crash, in order to ensure the energy consumption of a secondary energy consuming device (not explicitly illustrated in the drawings).

In case of a crash, i.e., when the central buffer coupling 1 is moved in the direction of the freight car body, such that it can be removed from the power flux transmitted between two adjacent freight car bodies in this fashion, the gladhand 2 of the central buffer coupling 1 is forced to hit against the supporting device 30 and in particular against the support 31 of the supporting device 30 when it moves in the direction of the freight car body. In the solution according to the invention, it is provided that the shearing elements 35 which join the support 31 of the supporting device 30 with the joining element 34 of the holder 32 of the supporting device 30 shear off in this case and hence make it possible that the support 31 can be pivoted away from the displacement pathway of the central buffer coupling 1 or the displacement pathway of the gladhand 2 of the central buffer coupling 1.

The invention is not restricted to the embodiment of the coupling arrangement illustrated as an example in the drawings, but results from an overall expert assessment of the patent claims and the description of the exemplary embodiment.

That which is claimed:

1. A coupling arrangement (100) for the front of a tracked vehicle, in particular rail vehicle, wherein the coupling arrangement (100) comprises:

a central buffer coupling (1) having a gladhand (2), a coupling shaft (3) supporting the gladhand (2) and a bearing (4) via which the coupling shaft (3) can be joined pivotable in at least one of a horizontal and vertical direction relative to the undercarriage of the vehicle; and an energy consuming device (50) allocated to the central buffer coupling (1) having at least one energy consuming element (65) with a destructive design, wherein:

the coupling arrangement (100) additionally comprises a supporting structure (10) with two longitudinal beams (11, 12) each arranged on the sides of the central buffer coupling (1) to limit a horizontal deflection of the central buffer coupling (1) and a crossbeam (13) arranged above the central buffer coupling (1) in such a way that a vertical deflection of the coupling shaft (3) relative to the undercarriage of the vehicle is limited by the crossbeam (13);

the crossbeam (13) is joined with the two longitudinal beams (11, 12) such that vertical forces applied from the central buffer coupling (1) onto the crossbeam (13) are transmitted from the crossbeam (13) to the two longitudinal beams (11, 12); and the two longitudinal beams (11, 12) each have respective beam longitudinal axes that extend parallel to a longitudinal axis of said energy consuming device (50) allocated to the central buffer coupling (1).

2. A coupling arrangement (100) according to claim 1, wherein:

an energy consuming device allocated to the crossbeam (13) having at least one energy consuming element (14, 15) with a destructive design is provided;

the at least one energy consuming element (14, 15) is designed such that it responds when a critical impact force defined in advance applied to the crossbeam (13) is exceeded and that it releases at least part of the energy generated in connection with the transmission of the impact force and introduced into the energy consuming device via the crossbeam (13) via plastic deformation with the simultaneous translational motion of the crossbeam (13) relative to the two longitudinal beams (11, 12) in the direction of the vehicle.

3. A coupling arrangement (100) according to claim 2, wherein:

at least one linear bearing (16, 17) is additionally provided, via which the crossbeam (13) is joined with the two longitudinal beams (11, 12); and the at least one linear bearing (16, 17) is designed such that it only permits the translational motion of the crossbeam (13) relative to the two longitudinal beams (11, 12) after the response of the at least one energy consuming element (14, 15).

4. A coupling arrangement (100) according to claim 3, wherein the at least one linear bearing (16, 17) is designed to have one linear guide rigidly joined with at least one of the two longitudinal beams (11, 12).

5. A coupling arrangement (100) according to claim 4, wherein the at least one linear bearing (16, 17) is designed in the shape of a guide sleeve and a guide ring.

6. A coupling arrangement (100) according to claim 4, wherein the at least one linear bearing (16, 17) is designed in the shape of a guide ring.

7. A coupling arrangement (100) according to claim 4, wherein at least one limit stop (20, 21) rigidly joined with at least one of the two longitudinal beams (11, 12) is provided, to limit the translational motion of the crossbeam (13) relative to the two longitudinal beams (11, 12) in the direction of the vehicle.

8. A coupling arrangement (100) according to claim 7, wherein:

the at least one linear bearing (16, 17) designed as linear guide comprises a face on the gladhand side; and the at least one limit stop is formed by the face on the gladhand side of the linear guide.

9. A coupling arrangement (100) according to claim 7, wherein the at least one limit stop (20, 21) is arranged in such a way relative to the at least one of the two longitudinal beams (11, 12) that the face on the gladhand side of the crossbeam (13) and the face of the gladhand side of the at least one of the two longitudinal beams (11, 12) are positioned in a common vertical plane, if the crossbeam (13) is moved maximally in the direction of the vehicle relative to the two longitudinal beams (11, 12).

10. A coupling arrangement (100) according to claim 2, wherein:

the at least one energy consuming element (14, 15) of the energy consuming device allocated to the crossbeam (13) is designed as a deformation tube having a first deformation tube section on the vehicle side and a second deformation tube section on the opposite side; and the second deformation tube section has a wider cross-section compared to the first deformation tube section and can be joined with the undercarriage of the vehicle via a bearing bracket (18, 19).

11. A coupling arrangement (100) according to claim 10, wherein a tapered ring arranged at the transition between the first and the second deformation tube section is additionally provided, which cooperates with a power transmission element (22) joined or joinable with the crossbeam (13) in such a way that an impact force applied to the crossbeam (13) is transmitted into the first deformation tube section via the power transmission element (22) and the tapered ring.

12. A coupling arrangement (100) according to claim 1, wherein the crossbeam (13) comprises an override protector (23) on the side facing the gladhand (2).

13. A coupling arrangement (100) according to claim 12, wherein at least one of the two longitudinal beams (11, 12) comprises an override protector (24) at its end section on the gladhand side.

14. A coupling arrangement (100) according to claim 1, wherein at least one of the two longitudinal beams (11, 12) comprises an override protector (24) at its end section on the gladhand side.

15. A coupling arrangement (100) according to claim 1, wherein the supporting structure (10) is designed in such a way that the face of the crossbeam (13) is arranged in a vertical plane between the vertical coupling plane and a vertical plane in which the faces of the longitudinal beams (11, 12) of the gladhand side are positioned, while the vehicle is in driving mode.

16. A coupling arrangement (100) according to claim 1, wherein:

the supporting structure (10) comprises a bearing bracket (25, 26) for each of the two longitudinal beams (11, 12), each joinable with the undercarriage of the vehicle; and the end section on the vehicle side of the two longitudinal beams (11, 12) is retained by the corresponding allocated bearing bracket (25, 26) and is joined with the bearing bracket (25, 26) by way of at least one shearing/tear-off element (27).

17. A coupling arrangement (100) according to claim 16, wherein each of the two bearing brackets (25, 26) allocated to the longitudinal beams (11, 12) is designed each as a linear bearing in such a way that it allows a translational motion of the longitudinal beam (11, 12) relative to the undercarriage of the vehicle after the at least one shearing/tear-off element (27) has failed or responded, respectively.

18. A coupling arrangement (100) according to claim 16, wherein each of the bearing brackets (25, 26) allocated to the longitudinal beams (11, 12) comprises a sleeve-shaped linear guide which retains an end section on the vehicle side of the corresponding longitudinal beam (11, 12).

19. A coupling arrangement (100) according to claim 1, wherein:

an absorbing device (55) having an absorbing element (56) with a regenerative design is additionally allocated to the central buffer coupling to absorb at least one of tractive and impact forces applied to the gladhand (2) during regular driving mode;

the absorption behavior of the absorbing element (56) is selected in such a way that the fronts of the gladhand (2) and the crossbeam (13) are positioned in a common vertical plane after the exhaustion of the operating consumption of the absorbing element (56) in connection with the impact power transmission and immediately after the response of the energy consuming element (65) of the energy consuming device (50) allocated to the central buffer coupling (1).

20. A coupling device (100) according to claim 1, wherein:

a supporting device (30) for vertical support of the coupling shaft (3) is additionally provided;

the supporting device (30) comprises a support (31) arranged below the central buffer coupling (1) and which is or can be brought in contact with the coupling shaft (3) as well as a holder (32) joined with the support (31) and mounted on the two longitudinal beams (11, 12) by way of a transverse web (65);

the holder (32) comprises a joining element (34) via which the support (31) is joined with the holder (32);

the joining element (34) defines a rotational axis (R) around which the support (31) can be rotated relative to the joining element (34); and at least one shearing element (65) is provided which connects the joining element (34) with the support (31) and which is designed to shear off a torque transmitted from the support (31) to the joining element (34) via the at least one shearing element (35) if an amount defined or definable in advance is exceeded, in order to allow a rotation of the support (31) relative to the joining element (34).

* * * * *